United States Patent [19]

Stef

[11] Patent Number: 4,459,918

[45] Date of Patent: Jul. 17, 1984

[54] STEERING TRUCK

[75] Inventor: Claude Stef, Puteaux, France

[73] Assignee: Creusot-Loire, Paris, France

[21] Appl. No.: 233,717

[22] Filed: Feb. 12, 1981

[30] Foreign Application Priority Data

May 9, 1980 [FR] France ..... 80 10510

[51] Int. Cl.[3] ..... B61F 3/10; B61F 5/04; B61F 5/20

[52] U.S. Cl. ..... 105/157 R; 105/167; 105/182 R; 105/183; 105/199 CB; 105/227

[58] Field of Search ..... 105/157 R, 182 R, 183, 105/199 CB, 158 R, 165, 166, 167, 168, 169, 227; 410/45

[56] References Cited

U.S. PATENT DOCUMENTS

| | | | |
|---|---|---|---|
| 245,920 | 8/1881 | Fee | 105/166 |
| 247,260 | 9/1881 | Luce | 105/169 |
| 656,381 | 8/1900 | Thompson et al. | 105/183 X |
| 960,145 | 5/1910 | Anger | 105/199 CB X |
| 1,277,889 | 9/1918 | Ethridge | 105/182 R X |
| 1,781,334 | 11/1930 | Liechty | 105/168 |
| 2,113,465 | 4/1938 | Kjolseth | 105/183 |
| 2,257,909 | 10/1941 | Kinne | 105/157 X |
| 2,371,182 | 3/1945 | Orr et al. | 105/183 |
| 2,896,552 | 7/1959 | Obes | 410/53 |
| 3,789,774 | 2/1974 | Wilk | 410/45 |
| 3,827,373 | 8/1974 | Mouneydiere | 105/183 X |

FOREIGN PATENT DOCUMENTS

| | | | |
|---|---|---|---|
| 2529083 | 1/1976 | Fed. Rep. of Germany | 105/183 |

*Primary Examiner*—Robert B. Reeves
*Assistant Examiner*—Howard Beltran
*Attorney, Agent, or Firm*—Pollock, Vande Sande & Priddy

[57] ABSTRACT

A truck or double bogie having forward and rear elemental bogies (1, 2). The vehicle body is carried at the middle by a spanner bolster or two longitudinal coupling beams (8, 9) which are supported, at each end and on each elemental bogie, on the ends of a transverse swingle bar (12, 13), resilient blocks (15) being inserted between the swingle bar and the bolsters (3, 4) of the elemental bogie. The buffer and coupling bodies (34) are arranged at the end of a guide shaft (32) which is freely articulated on a vertical central pivot (30) rigidly fixed to the vehicle body and on the vertical pivot (5) of the forward elemental bogie (1). The device is intended for use with bogies for railroad vehicles intended to run on poor quality track.

4 Claims, 5 Drawing Figures

IV
I
34
1
8
5
9
3
32
30
28
26
19
V
2
6
4

26
20
27
28
29
32
30
21
9
23
24
8
19
18

STEERING TRUCK

BACKGROUND OF THE INVENTION

The present invention relates to a double bogie for a railroad vehicle which is intended to run on lightweight track, or track of poor quality, in which curves of small radius are present.

Such track is able to withstand only low axis loads, which limits the capacity of the wagons, and consequently the economy of operation of the line. In order to reduce the axle load, it has been necessary to multiply the number of axles. One common solution has been to provide double bogies, i.e., to allow each end of the vehicle body to rest on an intermediate body which in its turn rests on two ordinary bogies, thus providing equal distribution of the load onto each elementary bogie, thereby having the load transmitted to the track by each axle.

Among the various designs of double bogies is the structure described in the French patent published under number 2,276,972, and more particularly its patent of addition, published under number 2,314,851. The said structure is a unit which is particularly well adapted to travel over track which is in poor condition, making use of its flexibility and its capacity to become deformed, so that each wheel follows the track irregularities without becoming detached from the track. In a design of this type, the body of the vehicle rests at the center of a spanner bolster or two independent laterally spaced coupling beams, the ends of which in their turn rest on the central cross member of each elemental bogie via the intermediary of a rocking arm which pivots at the center of the elemental bogie, and of resilient blocks which relieve the rocking arm of a large part of the load. In this way it is possible to obtain a high degree of relative distortion of the rolling unit with respect to the wagon body, and of one elemental bogie with respect to the other. However, such a device is intended to have the buffer and the coupling arrangement to the next wagon mounted on the wagon body, so that the rolling units are passively guided. The result is that, when, for example, the start of a curve is being negotiated, the rotational movement is imparted to the front bogie solely as a result of transverse reaction from the outer rail against the flanges of the corresponding wheels. This is particularly disturbing in the case of track in which curves of relatively small radius are present, and leads to premature wear on the flange, and hence the need for frequent re-machining of the tires, bringing about an increase in operating costs. One clearly can obtain better following of curves of small radius if the bogie is actively providing a guiding function, i.e., if the tractional forces are applied to the bogie itself. In this case, the actual effect is that, when the start of a curve is being negotiated, rotation of the bogie is first of all brought about by the tranverse component of the tractional force being exercised by the preceding wagon which is already negotiating the curve, so that the bogie assumes its normal position for the curve in advance, with less rubbing and consequently less wear between the tires of the wheels and the rail. Double bogies are known which are thus fitted with a generally automatic central coupling, and provide for a steering action when entering and leaving the curve. However, in these prior art double bogies, the coupling of the two elemental bogies is provided by a rigid chassis which supports all the load from the wagon body using a bearing of the center plate type, and which in its turn rests on the elemental bogies using further support of the center plate type; it is also this rigid chassis which has the buffer and coupling arrangement located on it. The result is that the whole assembly is highly rigid and adapts itself very badly to track which is uneven and of mediocre quality, and appreciable friction in the center plates hinders relative rotational displacement when entering or leaving a curve, particularly in the case of a curve of small radius. It will also be noticed that steering forces due to the direct coupling on the bogie are applied to a component carrying a high loading since it directly receives the weight of the wagon body.

The present invention provides a double bogie having a high capacity to be deformed, with the additional advantage of the provision of a steering effect when there are changes in the curvature of the track.

SUMMARY OF THE INVENTION

The invention relates to a double bogie for a railroad vehicle, comprising two associated elemental bogies one of which is a forward bogie arranged towards the end of the vehicle body, and the other of which is a rear bogie arranged inwardly, the vehicle body being carried at the center of a spanner bolster or two independent laterally spaced longitudinally coupling beams arranged in the region of, and on opposite sides of, the axis of the elemental bogies, the ends of the spanner bolster or coupling beams being supported, for each elemental bogie, on the ends of a transverse swingle bar articulated on the pivot of the bogie, transversely deformable resilient blocks being arranged between each end of the swingle bars and the bolster or cross-member carrying the pivot of the bogie, so that under normal load conditions the swingle bar transmits only a reduced load to the pivot.

According to the invention, the buffer bodies and the coupling arrangement are located at the end of a guiding shaft which is articulated freely on a pivot having a vertical axis rigidly fixed to the wagon body at the center of the whole unit, as well as on the vertical pivot of the forward bogie.

According to one preferred embodiment of the invention, the vehicle body is carried on an intermediate transverse support via the intermediary of a cylindrical articulation having a longitudinal axis, with means for maintaining the transverse support in the transverse plane of the vehicle body, the transverse support itself being carried on each one of the coupling beams via resilient blocks which are transversely deformable.

BRIEF DESCRIPTION OF THE DRAWINGS

The invention will be more clearly understood by reference to one particular embodiment which is given by way of example and illustrated in the attached drawings, in which.

DETAILED DESCRIPTION OF AN EMBODIMENT

Figure 1:
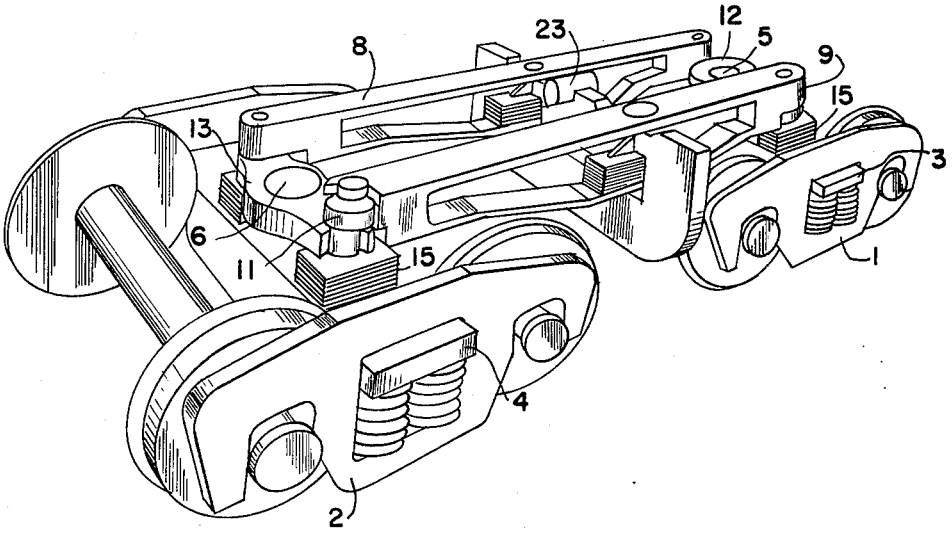
FIG. 1 is a perspective view showing the structure of the invention.
Figure 2:
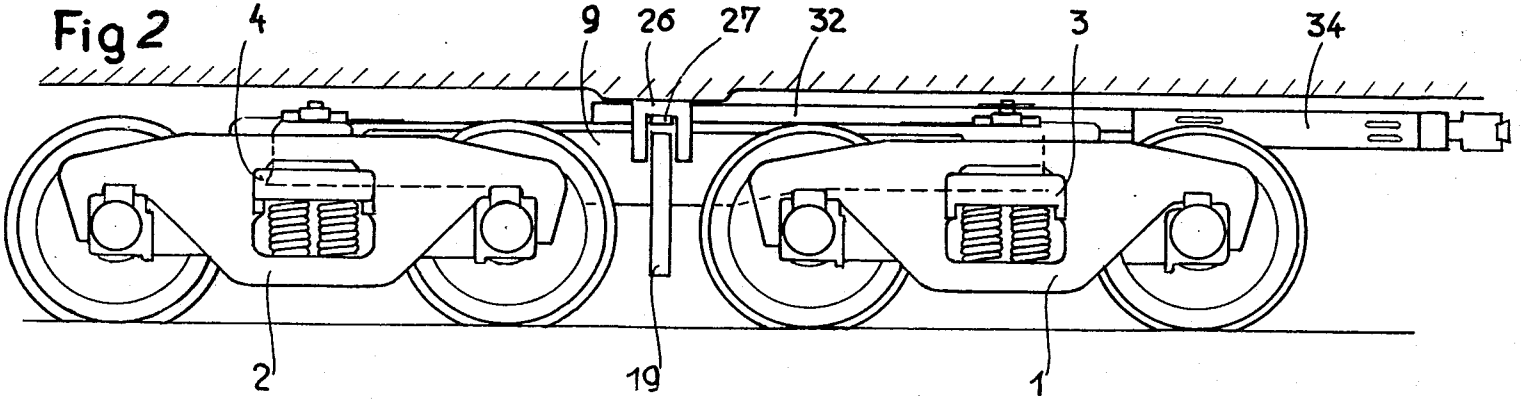
FIG. 2 is a side view of the outer part of a double bogie according to the invention.
Figure 4:
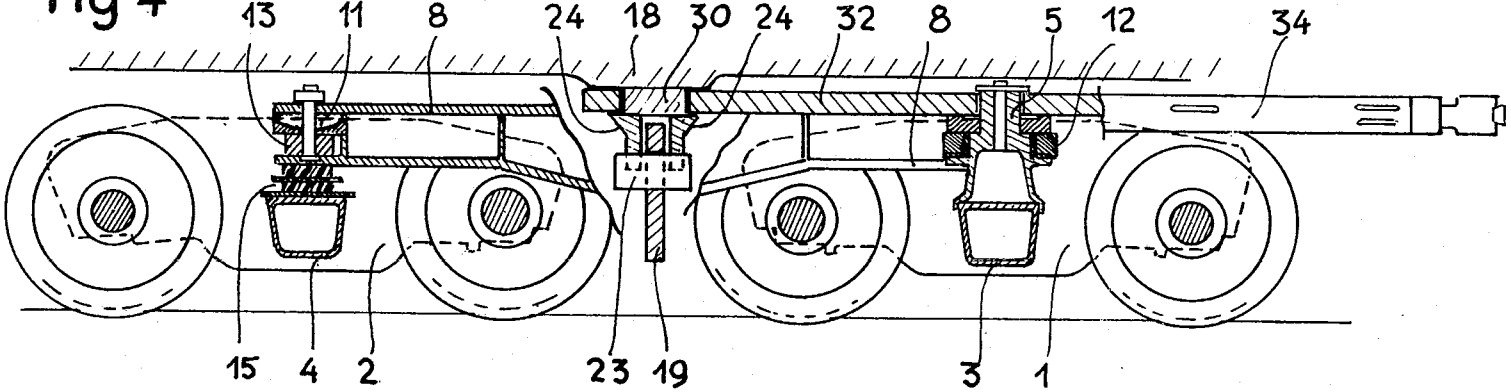
FIG. 4 is a longitudinal cross-sectional view taken in the direction of the arrows along line IV—IV in FIG. 3.
Figure 3:
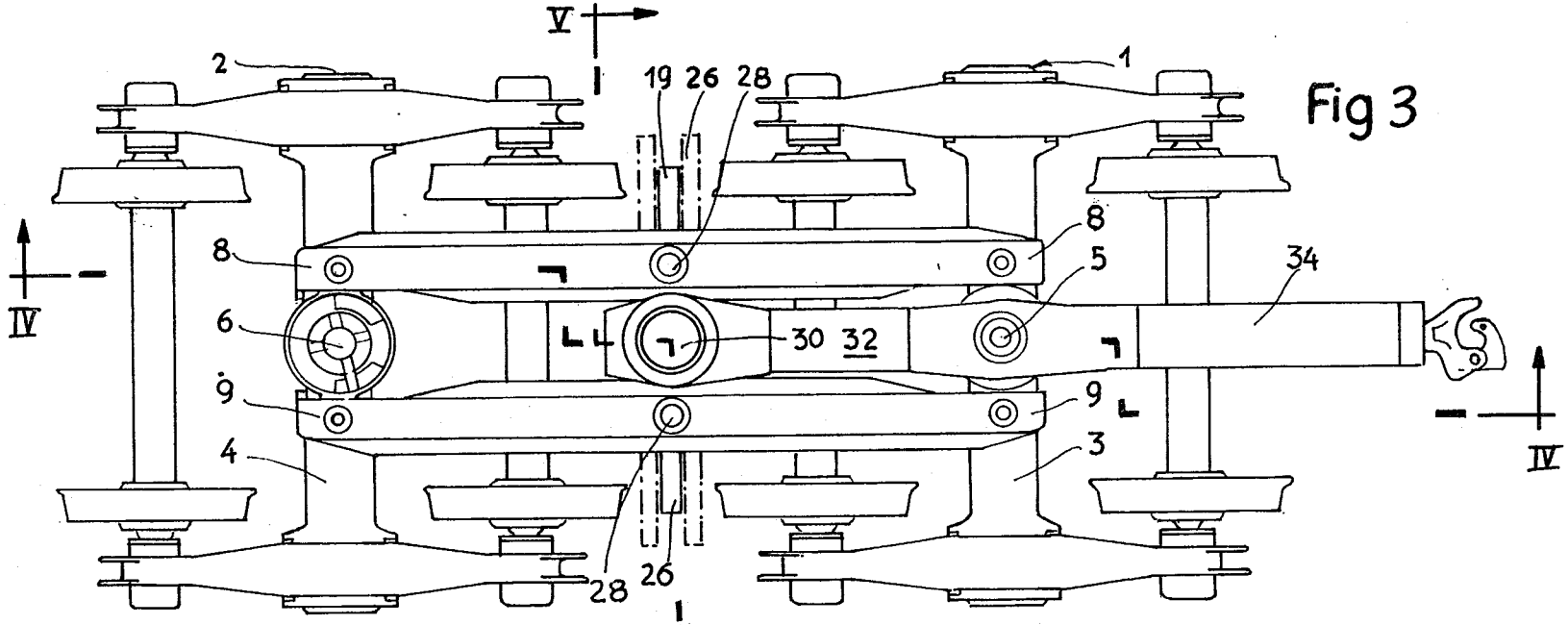
FIG. 3 is a plan view of the same bogie.
Figure 5:
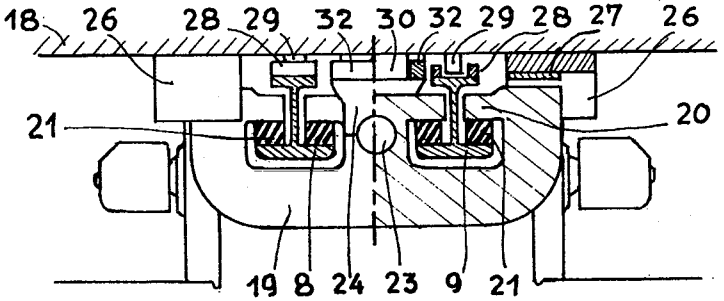
FIG. 5 is a transverse cross-sectional view taken in the direction of the arrows along line V—V in FIG. 3.

With reference to the drawings, the two elemental bogies of the known type are here indicated as a whole by 1 for the forward bogie and by 2 for the rear bogie, the forward bogie being the one which is closest to the end of the vehicle body. Each one of these elemental bogies 1 and 2 includes a bolster 3, 4 carried by the primary suspension, and is provided at its center with a pivot 5, 6. The bogies 1 and 2 are connected by a spanner bolster or two longitudinal coupling beams 8 and 9 of generally I-shaped cross section. The spanner bolster or coupling beams 8 and 9, are carried, at each of their ends, using a spherical swivel joint 11, on the end of a transverse swingle bar 12 or 13, each one of which articulates on the vertical axis pivot 5 or 6. Resilient blocks 15, which may comprise rubber-steel composite blocks deformable in the transverse sense, are inserted between the ends of the swingle bars 12 or 13 and the bolster 3 or 4 of the corresponding pivots, so as to transfer directly onto the bolster at least a large part of the load received by the end of the coupling beams.

The swingle bar 12 or 13 is consequently relieved of the load on it and is not impeded from turning about its pivot when, negotiating a curve, the two elemental bogies cease to be parallel. Rotation of the swingle bars is made possible by the transverse deformation of the blocks 15, which then engenders a recall couple when leaving the curve in order to realign the two elemental bogies.

It is this arrangement which gives the whole assembly a high deformation flexibility, both in order to absorb local subsidence or humps encountered in track in a poor state, and for absorbing distortions due to local subsidence of one rail only. The capacity of the flexible bogie to follow deformations in the track without becoming de-railed is improved even more by the design of the support for the vehicle body on a spanner bolster or the coupling equalizing beams 8 and 9.

The vehicle body, which is shown here only by the supporting cross-piece 18, is carried on a vertical flat transverse support 19 which is cut out in order to form four jaws 20 surrounding two orifices which are partially closed. The transverse support 19 is carried on a spanner bolster or the two coupling beams 8 and 9 by means of its jaws 20, composite resilient blocks 21 being inserted between the jaws and the lower flange of the coupling beams. The transverse support 19 has a longitudinal cylindrical shaft 23 passing through it, and the vehicle body carries, on each side of the transverse support, two stays 24 which have a semicircular cut-out portion at their lower part, and these bear on the shaft 23. The transverse support 19 is moreover held inside two parts 26 in the form of an inverted U rigidly fixed to the vehicle body, so that it is always obliged to remain perpendicular to the longitudinal axis of the vehicle body. Transverse stop members 27 limit the relative degree of angular deflection between the transverse support 19 and the vehicle body about the shaft 23. Finally, the spanner bolster or coupling beams 8 and 9 are provided, on their upper flange, with housings 28 which receive, with provision for vertical play, the stop members 29 rigidly fixed to the vehicle body, for transmitting longitudinal tractional or breaking forces.

The stays 24 are linked to the vehicle body by a cylindrical portion 30 forming a pivot on which a flat horizontal guiding shaft 32 articulates. The guiding shaft 32 also articulates freely about the pivot with the vertical axis 5 at the center of the bolster or cross head 3 of the forward bogie. Towards its front end, the guiding shaft 32 is extended by the standard coupling block 34, which in this case is an automatic central coupling.

It will be seen that a double bogie of the "guiding" type has been provided, with all the advantages resulting from the steering action applied to the forward bogie in order to facilitate its correct positioning when changes in the track curvature occur. It will further be noted that the tractional forces, and the steering effect applied to the bogies, are performed by a guiding shaft which is freely articulated and which is not subject to loading from the vehicle body. The load is in effect directly transmitted from the vehicle body cross piece 18 to the transverse support 19 by the stay 24, but no vertical load is applied to the guiding shaft 32 through the pivot 30.

Finally, it will be seen that the addition of the guiding shaft does not introduce any supplementary rigidity into this double bogie having a high capacity to become deformed when encountering track irregularities of any type.

I claim:

1. Truck assembly for railroad vehicle body, comprising (a) two component bogies forming each truck and connected by a spanner bolster mounted on said bogies by pivots, including a forward bogie (1) arranged adjacent each end of said vehicle body, and a rear bogie (2) arranged centrally of said vehicle body;

(b) said body of said vehicle being supported centrally of said spanner bolster between said bogies;

(c) said spanner bolster being formed of spaced beams, ends of said beams (8, 9) being pivotally supported, with respect to each component bogie (1, 2), on a transverse swingle bar (12, 13) articulated on the pivot of each said bogie;

(d) transversely deformable resilient blocks (15) being arranged between each end of said swingle bars (12, 13) and a bolster (3, 4) carrying said pivot of said bogie, whereby, under load conditions, said swingle bar transmits only a reduced load to said pivot; and (e) a pole (32) hinged to both a vertical pivot (30) solid with said body centrally of the truck assembly, and to the vertical pivot (5) of said forward composite bogie, said pole having a forward end for the attachment of a coupler.

2. Truck assembly according to claim 1, wherein said ends of said coupling beams (8, 9) are supported on the ends of said swingle bars (12, 13) by means comprising a swivel joint.

3. Truck assembly according to claim 1, wherein said body of said vehicle rests on an intermediate transverse support (19) via cylindrical shaft (23) having an axis extending longitudinally of said assembly, means (26) being provided for maintaining said intermediate transverse support (19)in a plane transverse to said body of said vehicle, said intermediate transverse support resting on each one of said coupling beams (8, 9) through the intermediary of transversely deformable resilient blocks (21).

4. Truck assembly according to claim 3, wherein said ends of said coupling beams (8, 9) are supported on the ends of said swingle bars (12, 13) by means comprising a swivel joint.

* * * * *